US010535957B2

(12) United States Patent
Zhao

(10) Patent No.: US 10,535,957 B2
(45) Date of Patent: Jan. 14, 2020

(54) ELECTRICAL CONNECTOR HAVING A SHIELDING SHELL UPWARDLY ABUTTING A GROUNDING PLATE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/166,186

(22) Filed: Oct. 22, 2018

(65) Prior Publication Data

US 2019/0123490 A1 Apr. 25, 2019

(30) Foreign Application Priority Data

Oct. 20, 2017 (CN) ..... 2017 1 0985913

(51) Int. Cl.

| | |
|---|---|
| ***H01R 13/658*** | (2011.01) |
| ***H01R 13/6585*** | (2011.01) |
| ***H01R 13/6591*** | (2011.01) |
| ***H01R 24/60*** | (2011.01) |
| *H01R 107/00* | (2006.01) |
| *H01R 12/70* | (2011.01) |

(52) U.S. Cl.

CPC ..... *H01R 13/6585* (2013.01); *H01R 13/6591* (2013.01); *H01R 24/60* (2013.01); *H01R 12/707* (2013.01); *H01R 2107/00* (2013.01)

(58) Field of Classification Search

CPC . H01R 13/6591; H01R 13/6585; H01R 24/60
See application file for complete search history.

(56) References Cited

U.S. PATENT DOCUMENTS

| | | | | |
|---|---|---|---|---|
| 9,935,401 | B2 | 4/2018 | Tsai et al. | |
| 9,954,303 | B2 * | 4/2018 | Guo | H01R 12/722 |
| 10,020,619 | B2 * | 7/2018 | Zhang | H01R 12/7082 |
| 2015/0244111 | A1 | 8/2015 | Ju et al. | |
| 2015/0364883 | A1 | 12/2015 | Yu et al. | |

FOREIGN PATENT DOCUMENTS

| | | |
|---|---|---|
| CN | 204011986 U | 12/2014 |

* cited by examiner

*Primary Examiner* — Ross N Gushi
(74) *Attorney, Agent, or Firm* — Wei Te Chung; Ming Chieh Chang

(57) ABSTRACT

An electrical connector includes: an insulative housing having a base and a tongue; an upper and a lower rows of contacts secured to the insulative housing and exposed, respectively, to two opposite faces of the tongue; a grounding plate arranged between the upper row of contacts and the lower row of contacts; and a shielding shell enclosing the insulative housing, wherein the grounding plate has a pair of side tails exposed to an outside of the insulative housing, and the shielding shell has a pair of soldering legs upwardly abutting the pair of side tails of the grounding plate.

5 Claims, 11 Drawing Sheets

ELECTRICAL CONNECTOR HAVING A SHIELDING SHELL UPWARDLY ABUTTING A GROUNDING PLATE

BACKGROUND OF THE INVENTION

1. Field of the Invention

The present invention relates to an electrical connector including an insulative housing retaining two rows of contacts and a middle grounding plate, and a shielding shell enclosing the insulative housing, wherein the shielding shell has a pair of soldering legs upwardly abutting the grounding plate reliably.

2. Description of Related Arts

U.S. Pat. No. 9,935,401 discloses an electrical connector, comprising an insulative housing having a base and a tongue, an upper and a lower rows of contacts secured to the insulative housing and exposed, respectively, to an upper and a lower faces of the tongue, a grounding plate arranged between the upper row of contacts and the lower row of contacts, and a shielding shell consisting of an inner shell and an outer cover enclosing the insulative housing. The grounding plate has a pair of soldering tails. The outer cover of the shielding shell has a pair of soldering legs and the inner shell of the shielding shell has a pair of contacting pieces in contact with the pair of soldering tails of the grounding plate.

SUMMARY OF THE INVENTION

An electrical connector comprises: an insulative housing having a base and a tongue; an upper and a lower rows of contacts secured to the insulative housing and exposed, respectively, to two opposite faces of the tongue; a grounding plate arranged between the upper row of contacts and the lower row of contacts; and a shielding shell enclosing the insulative housing, wherein the grounding plate has a pair of side tails exposed to an outside of the insulative housing, and the shielding shell has a pair of soldering legs upwardly abutting the pair of side tails of the grounding plate.

DETAILED DESCRIPTION OF THE PREFERRED EMBODIMENT

Figure 1:
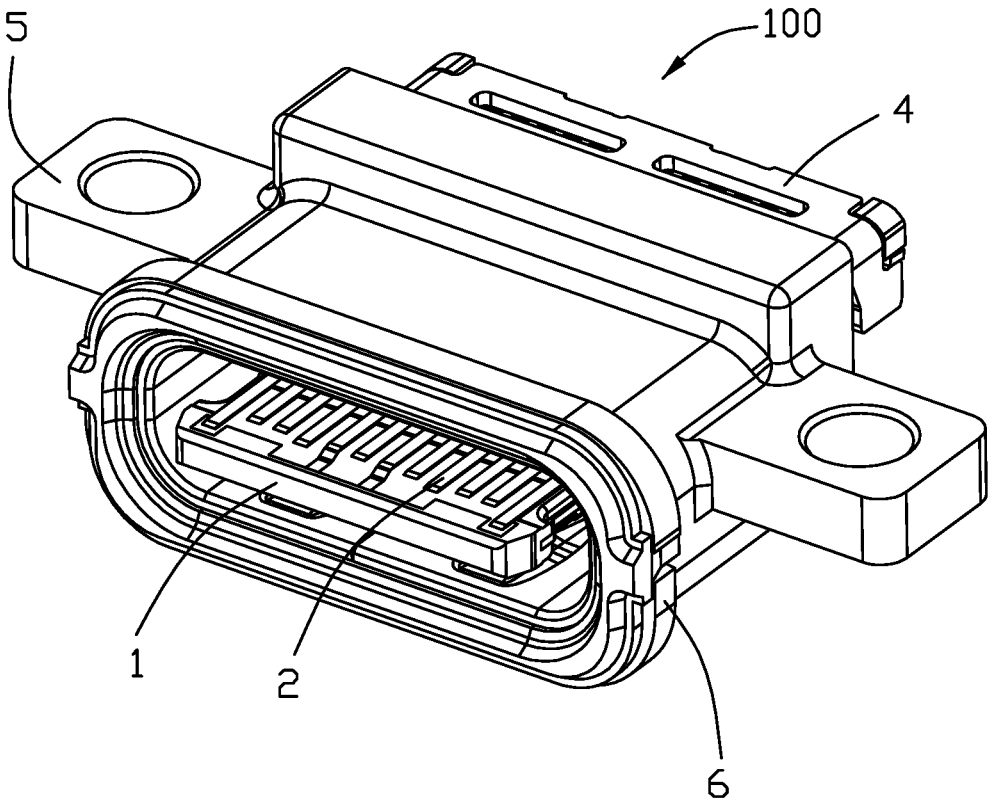
FIG. 1 is a front and top perspective view of an electrical connector in accordance with the present invention.
Figure 2:
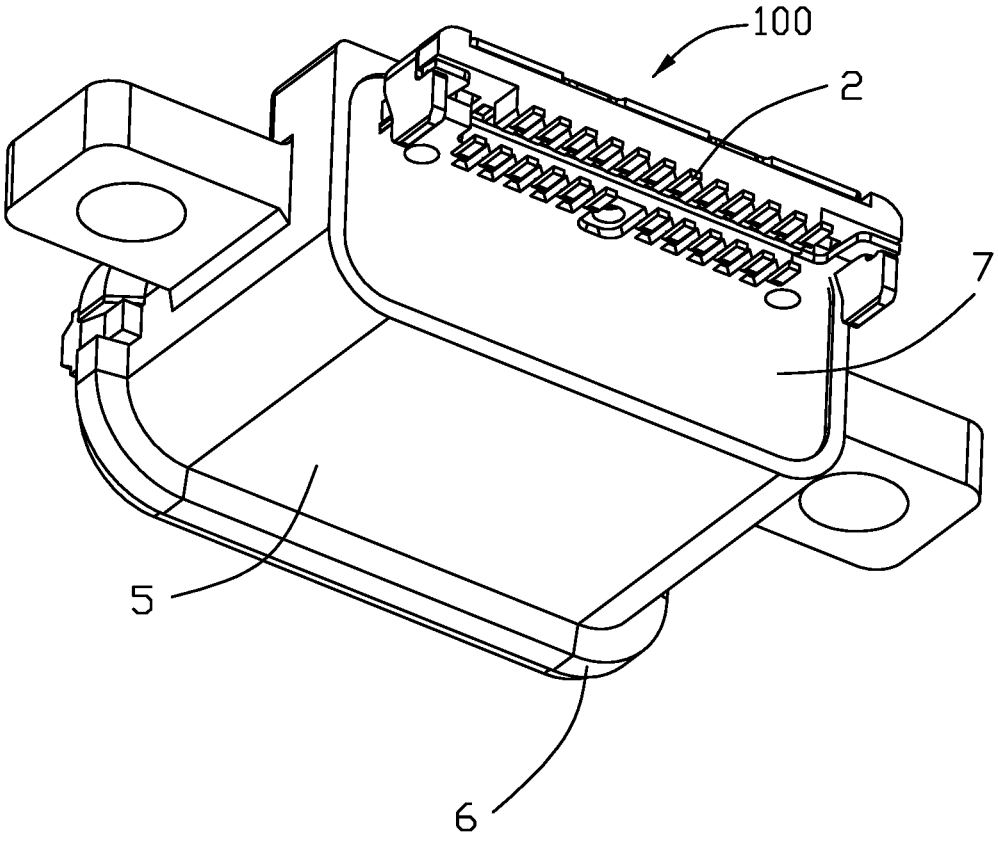
FIG. 2 is a rear and bottom perspective view of the electrical connector.

Referring to FIGS. 1-11, an electrical connector 100 comprises an insulative housing 1 having a base 15 and a tongue 14, an upper and a lower rows of contacts 2 secured to the insulative housing 1 and exposed, respectively, to an upper and a lower faces of the tongue 14, a grounding plate 3 arranged between the upper row of contacts 21 and the lower row of contacts 22 in a vertical direction, and a shielding shell 4 enclosing the insulative housing 1. The insulative housing 1, the contacts 2, and the grounding plate 3 constitute a contact module. The electrical connector may further comprise an insulative outer cover 5, a front sealing member 6, and a rear sealing member 7.

Figure 3:
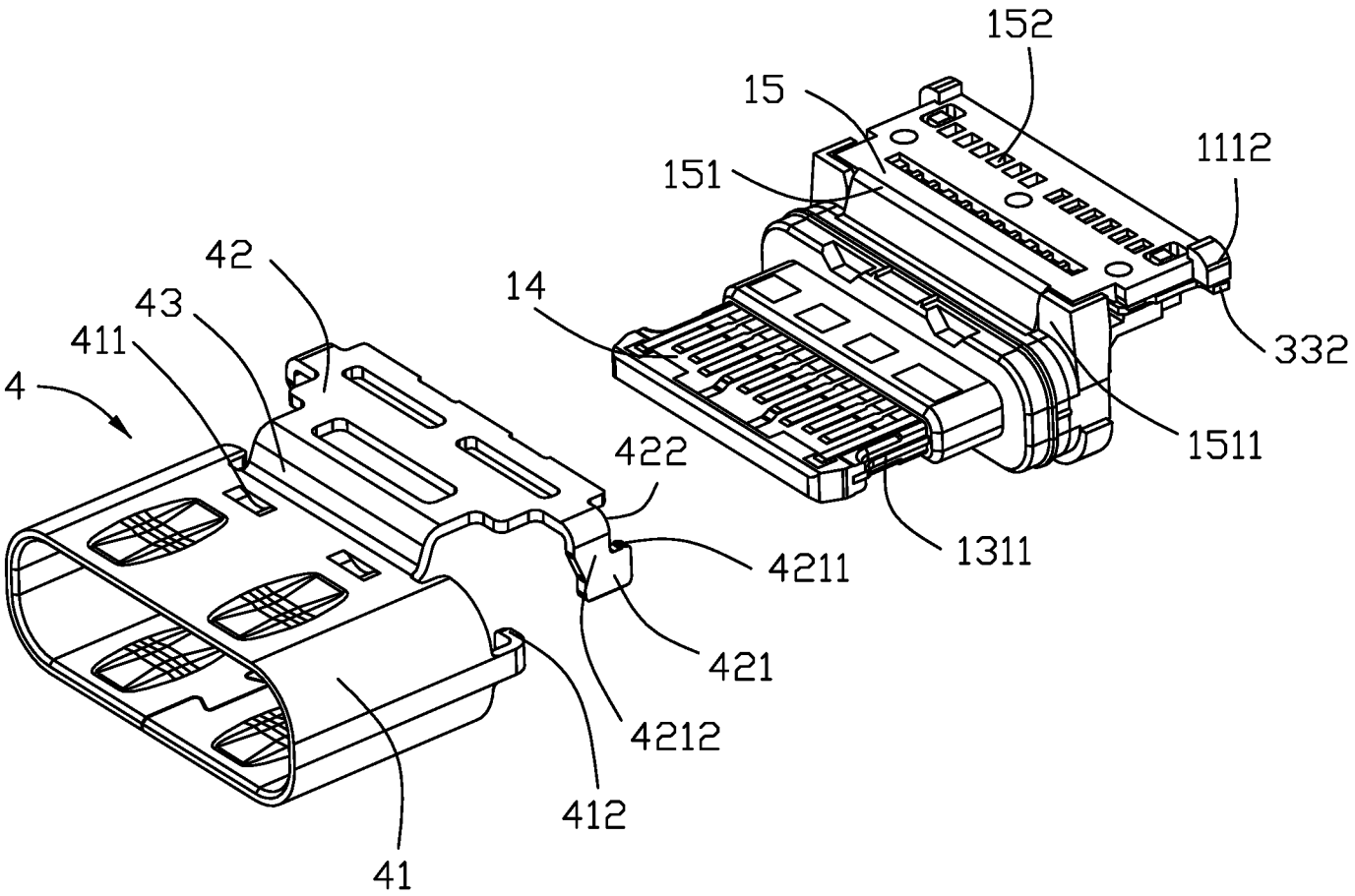
FIG. 3 is an exploded view of a contact module and a shielding shell of the electrical connector.
Figure 7:
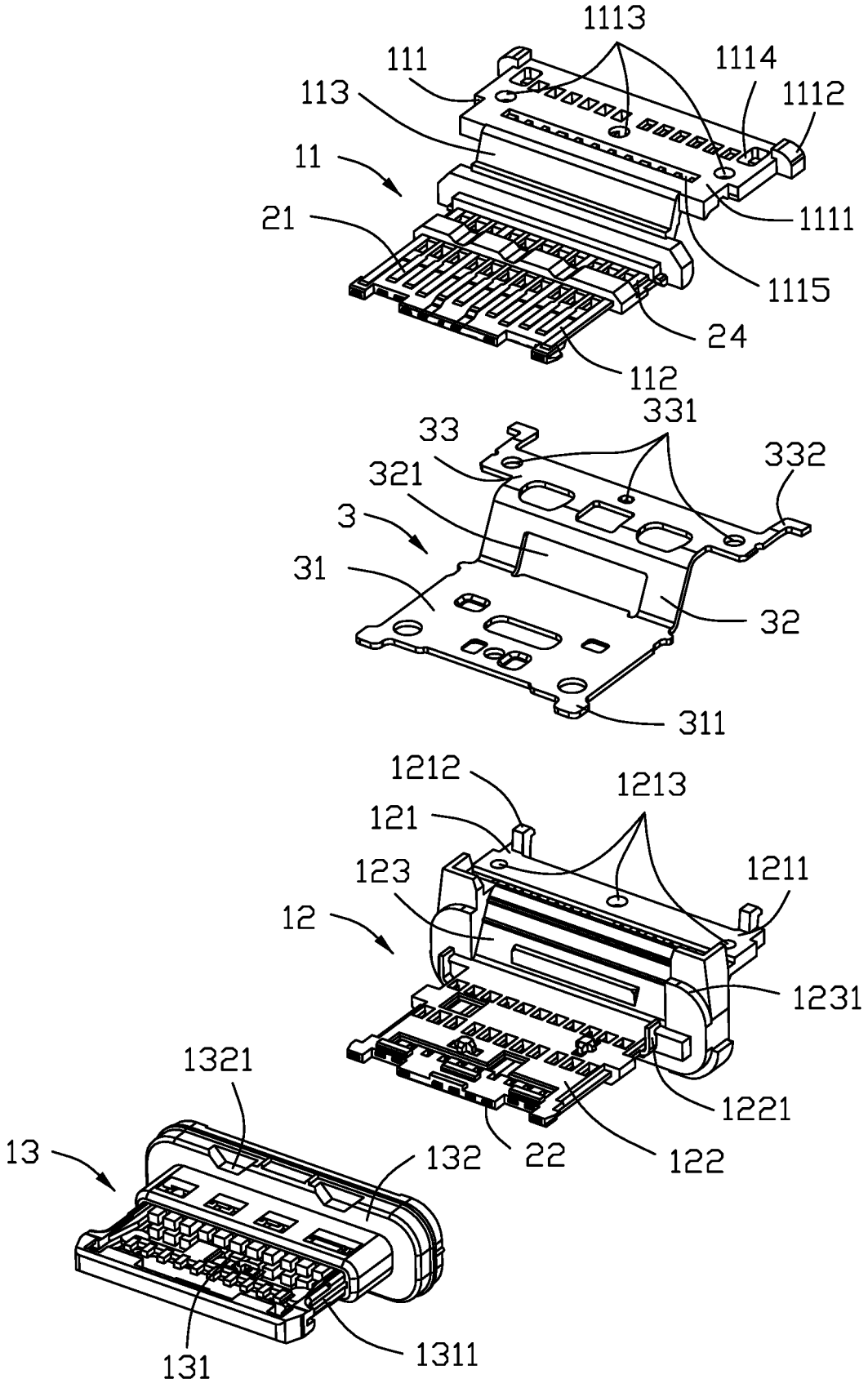
FIG. 7 is an exploded view of the contact module in FIG. 3.
Figure 8:
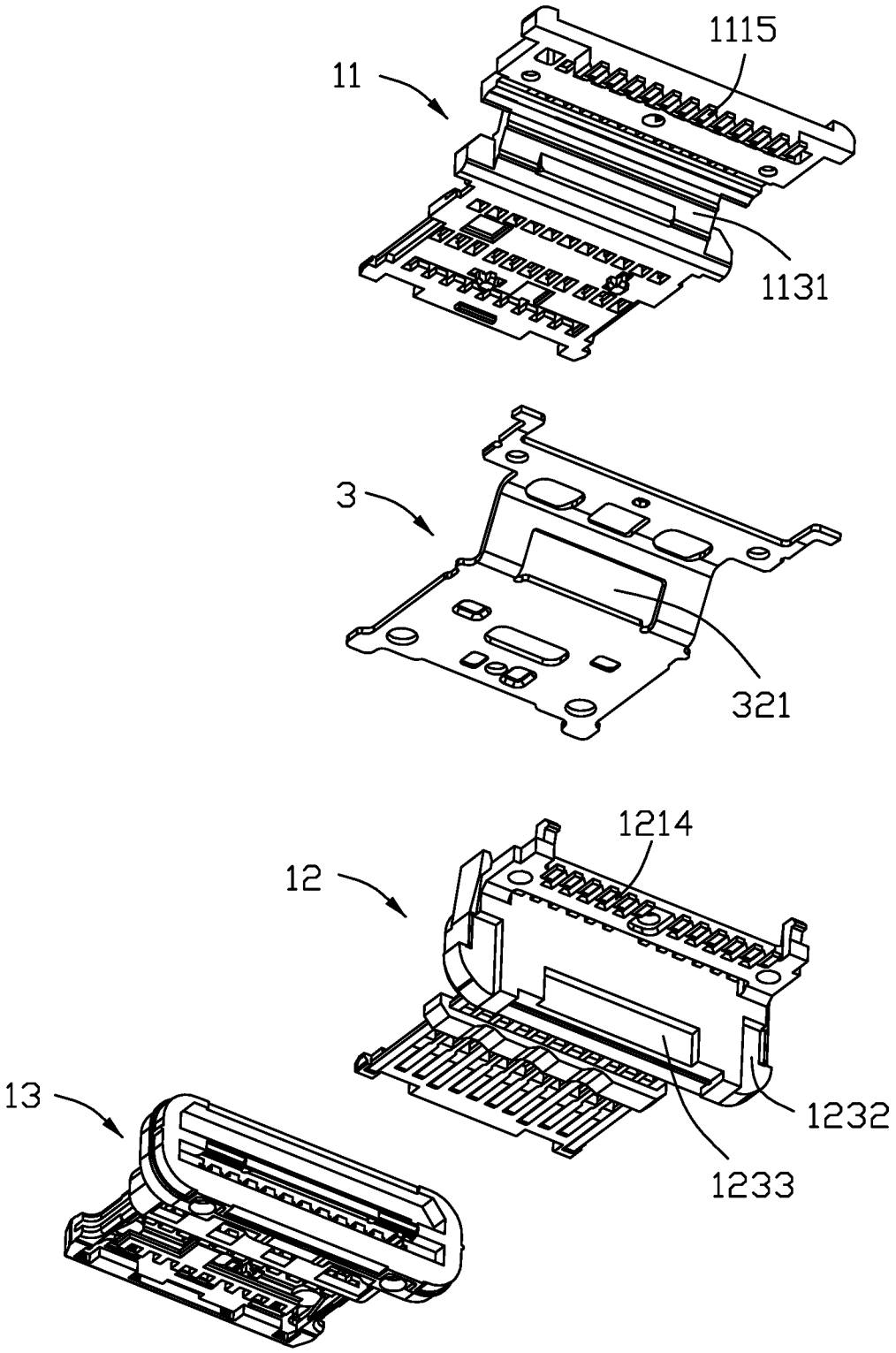
FIG. 8 is a view similar to FIG. 7 but from another perspective.

Referring specifically to FIGS. 3 and 7-8, the insulative housing 1 includes a base 15 and a tongue 14 extending forwardly from the base in a front-to-back direction perpendicular to the vertical direction. The base 15 has a front main portion 151 and a rear extension 152. A middle step 1511 is formed between the portions 151 and 152. The insulative housing 1 is constructed of a first insulator 11, a second insulator 12, and a third insulator 13 molded in a known manner with the first and second insulators. The first insulator 11 has a base portion 111, a tongue portion 112, and an inclined portion 113 therebetween. The base portion 111 has a planar part 1111, a pair of blocks 1112, three positioning holes 1113, two latching holes 1114, and a window 1115. The inclined portion 113 has a step 1131.

The second insulator 12 has a base portion 121, a tongue portion 122, and an inclined portion 123 therebetween. The base portion 121 has a planar part 1211, a pair of latches 1212, three positioning holes 1213, and a window 1214. The inclined portion 123 has a step 1231, a pair of side recesses 1232, and a middle recess 1233.

The third insulator 13 has a tongue portion 131 and a base portion 132. The base portion 132 has a respective pair of recesses 1321 on each of an upper and a lower portions thereof.

Figure 5:
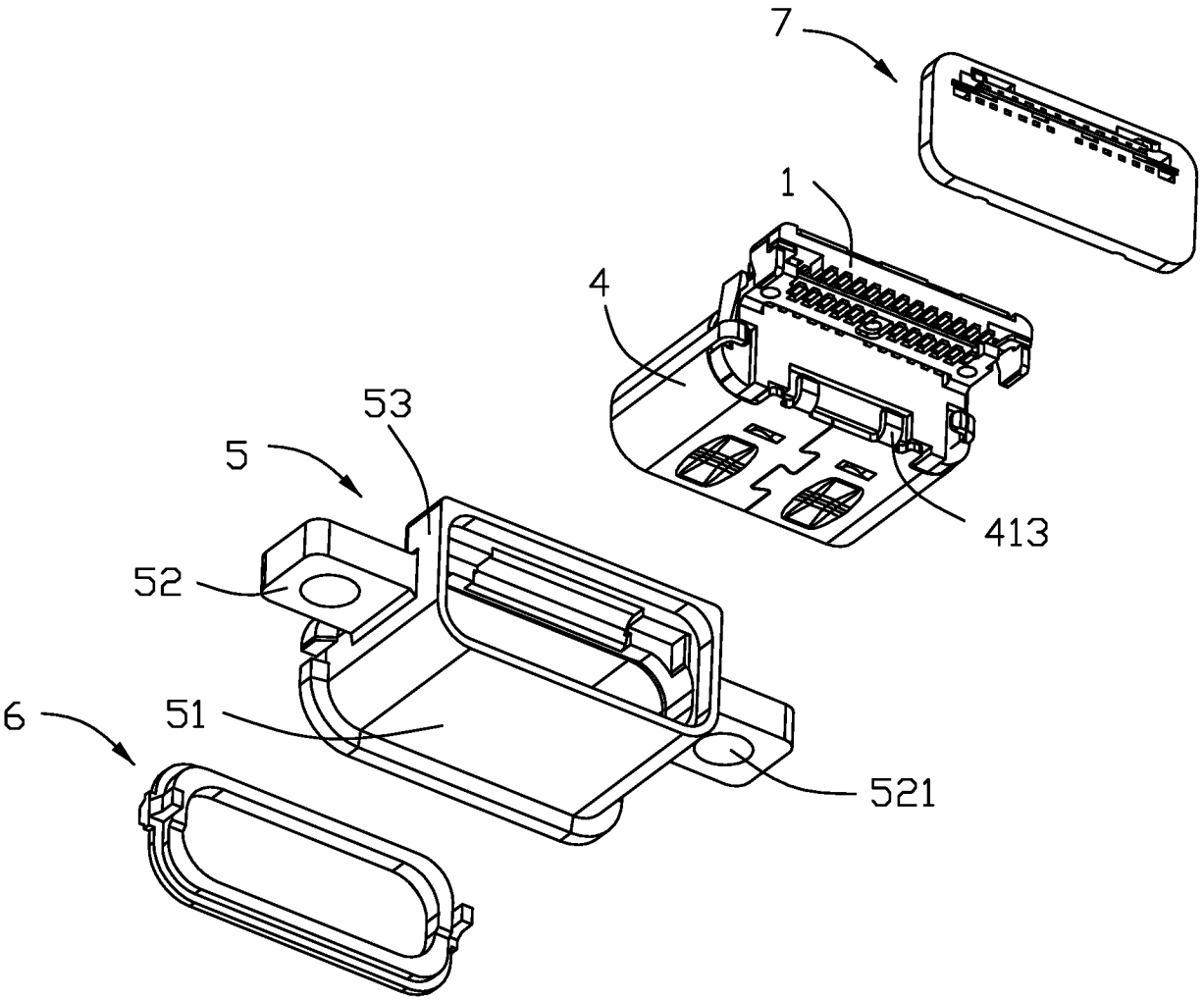
FIG. 5 is a further exploded view of FIG. 2.
Figure 6:
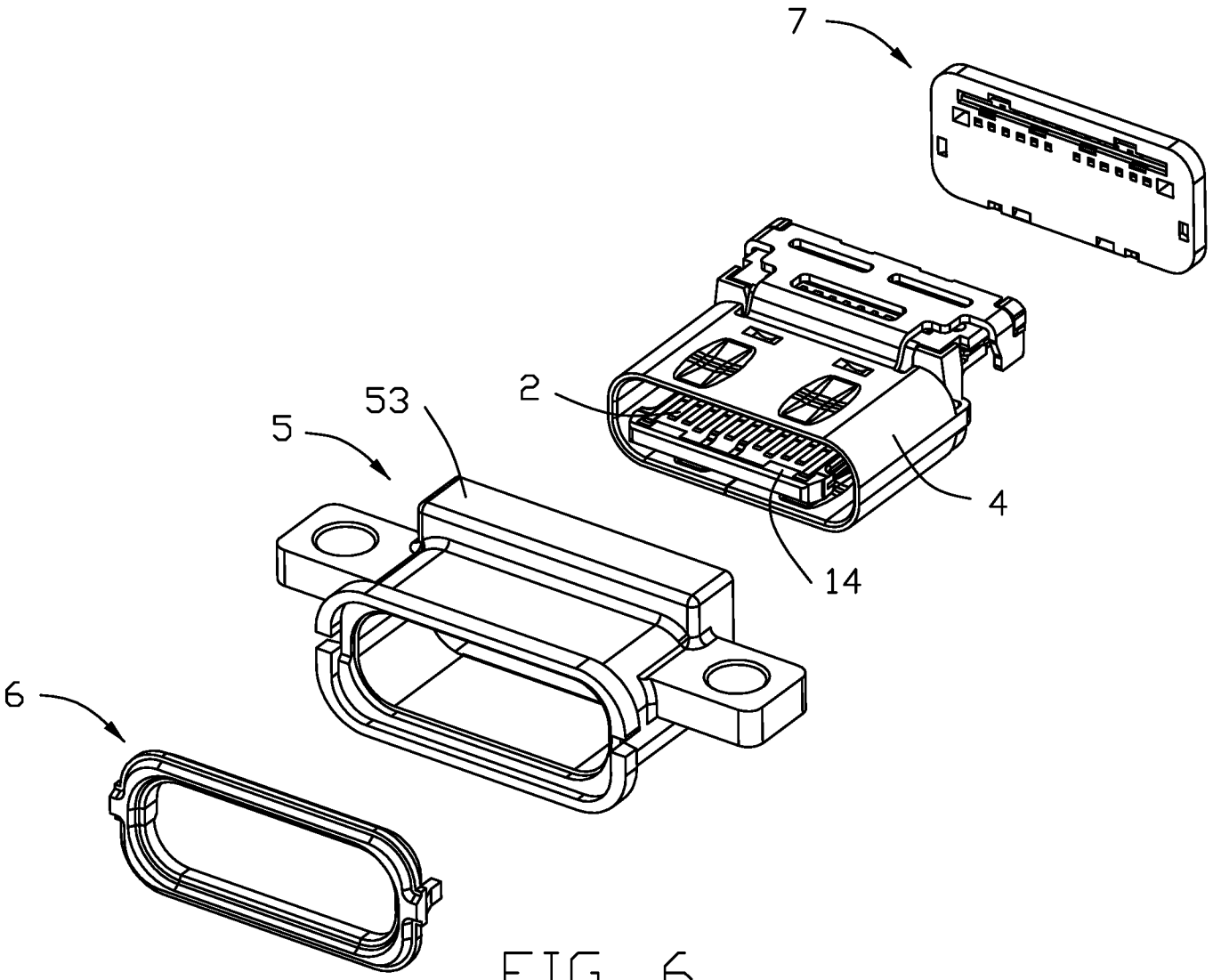
FIG. 6 is a further exploded view of FIG. 1.

Referring to FIGS. 1, 5, and 7, each contact 2 has a contacting portion 23 exposed to the tongue 14, a securing portion 24 secured to the base 15, and a soldering portion 25 extending outside the base 15 for mounting to a printed circuit board (not shown). The upper contacts 21 and the first insulator 11 constitute an upper contact module unit; the lower contacts 22 and the second insulator 12 constitute a lower contact module unit. The contact module includes the upper and lower contact module units.

Referring to FIGS. 7-8, the grounding plate 3 includes a main portion 31 between the tongue portions 112 and 122, a plate portion 33 between the base portions 111 and 121, and an angled/transitional portion 32 between the inclined portions 113 and 123. The main portion 31 has a pair of front protrusions 311. The angled portion 32 has a hole 321 through which the step 1231 extends to abut the step 1131. The plate portion 33 has holes 331 aligned with the positioning holes 1113 and 1213 for filling up with molten plastics during molding. The grounding plate 3 has a pair of side tails 332 extending initially rearwardly in the front-to-back direction, and further sidewardly in the transverse direction perpendicular to both the vertical direction and the front-to-back direction, and exposed to an outside of the insulative housing 1. The side tail 332 has a downwardly inclined end 3321. The pair of side tails 332 are positioned under the pair of blocks 1112 of the base portion 111.

Figure 4:
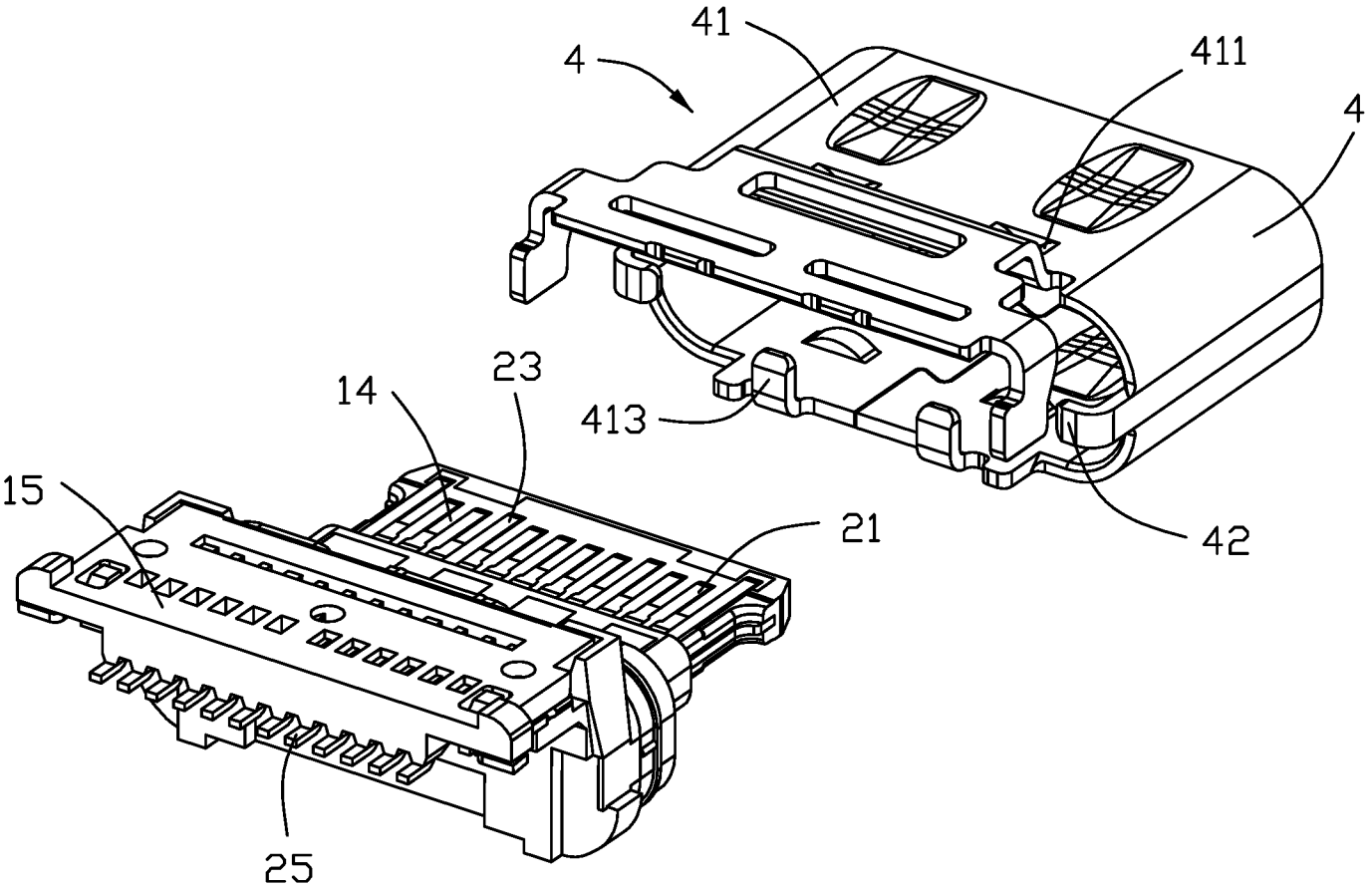
FIG. 4 is a view similar to FIG. 3 but from another perspective.
Figure 9:
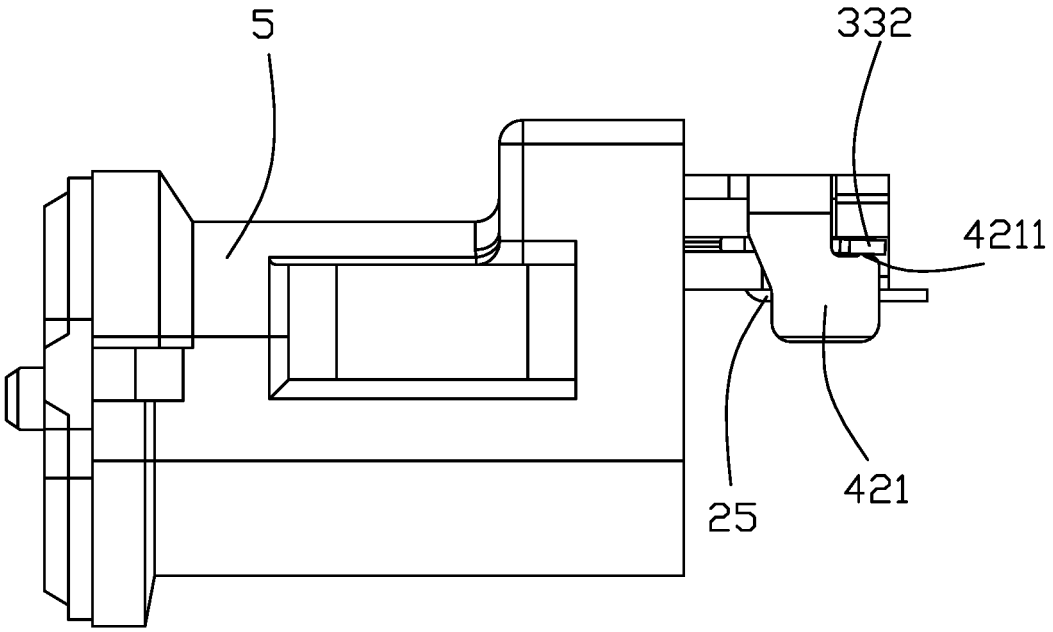
FIG. 9 is a side view of the electrical connector.
Figure 10:
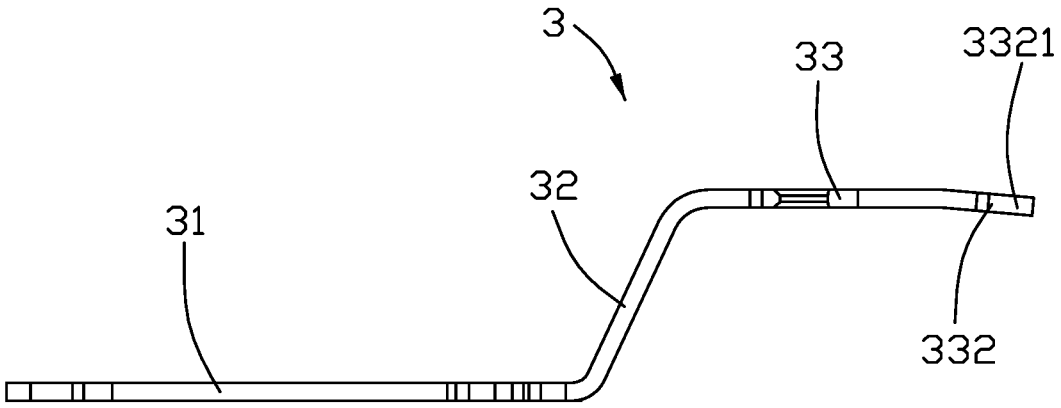
FIG. 10 is a side view of a grounding plate of the contact module.
Figure 11:
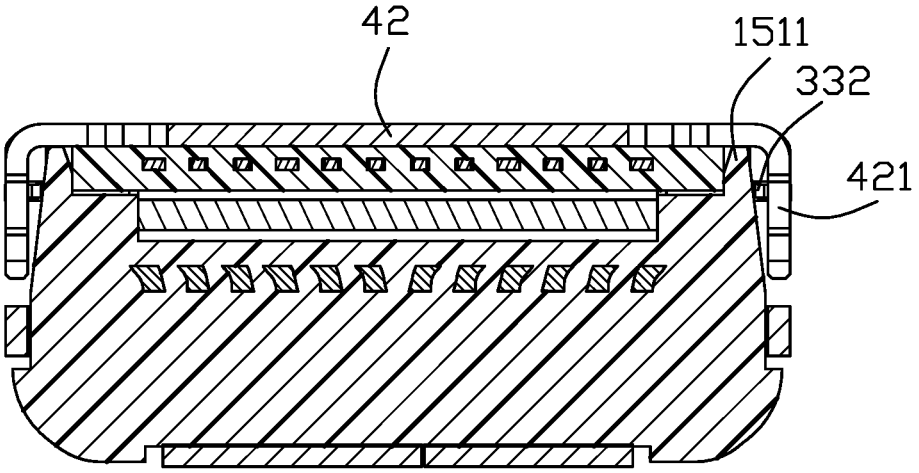
FIG. 11 is a cross-sectional view of the electrical connector of FIG. 1 to show the relation of the soldering leg of the rear shielding shell and the abutment section of the housing.

Referring to FIGS. 3-4 and 9, the shielding shell 4 has a tubular portion 41, a rear cover 42, and a step 43 therebetween. The step 43 is accommodated on the step 1511. The tubular portion 41 has features 411 received in the recesses 1321, a first pair of stops 412 received in the recesses 1232, and a second pair of stops 413 received in the recess 1233. The rear cover 42 is leveled higher than the tubular portion 41 and has a pair of soldering legs 421 for mounting to the aforementioned printed circuit board (not shown). A notch 422 is formed at a junction of the leg. The soldering leg 421 has a bearing portion 4212 for resting the inclined end 3321 of the side tail 332. Preferably, the bearing portion 4212 has an upper protrusion 4211 for upwardly abutting the side tail 332. The rear cover 42 is located above the plate portion 33 while the bearing portions 4212 of the soldering legs 421 are located under the side tails 332 of the plate portion 33. After assembling the shielding shell 4, the par of blocks 1112 are at the notch 422 and the pair of side tails 332 of the grounding plate 3 are clamped between the pair of blocks 1112 and the pair of bearing portions 4212 of the soldering legs 421.

Referring to FIGS. 1-2 and 5-6, the insulative outer cover 5 may include a tubular portion 51, a pair of lugs 52, and a rear covering portion 53. The lug 52 has a hole 521.

Since the side tail 332 is bent to have a downwardly inclined end 3321 in a slightly oblique manner, and the bearing portion 4212 of the soldering leg 421 is located below the side tail 332 and has the protrusion 4211, a positive retention and reliable contact between the side tail 332, which has a lying L-shaped configuration, and the soldering leg 421, which has an upstanding L-shaped configuration, for effective grounding is achieved. In this embodiment, the soldering leg 421 is configured not to hinder the middle step 1511 when the housing 1 is forwardly assembled into the shielding shell 4 in a front-to-back direction. Understandably, the soldering leg 421 can be bent to his final position after the housing 1 has been assembled into the shielding shell 4 alternately.

What is claimed is:

1. An electrical connector comprising:

an insulative housing having a base and a tongue;

an upper and a lower rows of contacts secured to the insulative housing and exposed, respectively, to an upper and a lower faces of the tongue;

a grounding plate arranged between the upper row of contacts and the lower row of contacts; and a shielding shell enclosing the insulative housing, wherein the grounding plate has a pair of side tails exposed to an outside of the insulative housing, the shielding shell has a pair of soldering legs upwardly abutting the pair of side tails of the grounding plate, and each soldering leg of the shielding shell has an upper protrusion, and each side tail of the grounding plate has an inclined end resiliently abutting the upper protrusion.

2. The electrical connector as claimed in claim 1, wherein the shielding shell includes a front tubular portion and a rear cover leveled higher than the tubular portion, the pair of soldering legs are disposed on the rear cover, and each soldering leg has a bearing portion located below a corresponding side tail of the grounding plate.

3. The electrical connector as claimed in claim 1, wherein the insulative housing includes a pair of blocks, each of the pair of soldering legs of the shielding shell has a bearing portion, and the pair of side tails of the grounding plate are clamped between the pair of blocks and the pair of bearing portions.

4. An electrical connector comprising:

an insulative housing having a base and tongue extending forwardly from the base;

an upper and a lower row of contacts secured to the housing and exposed to an upper and a lower faces of the tongue, respectively;

a metallic shielding plate retained by the housing and between the upper and the lower rows of contacts, and including a main portion in the tongue, a plate portion located behind the main portion in a front-to-back direction and above the main portion in a vertical direction perpendicular to the front-to-back direction, and a transitional portion between the main portion and the plate portion in the front-to-back direction; and a metallic shielding shell having a tubular portion enclosing the tongue, a rear cover located behind the tubular portion in the front-to-back direction and above the tubular portion in the vertical direction, and downwardly shielding the base in the vertical direction, and a step between the tubular portion and the rear cover in the front-to-back direction corresponding to the transitional portion; wherein the rear cover has a soldering leg mechanically and electrically contacts a tail which extends from the plate portion of the shielding plate; wherein the soldering leg defines an upstanding L-shaped configuration, and the tail defines a lying L-shaped configuration in a slightly oblique manner for enhancing retention between the soldering leg and the tail.

5. An electrical connector comprising:

an insulative housing having a base and tongue extending forwardly from the base;

an upper and a lower row of contacts secured to the housing and exposed to an upper and a lower faces of the tongue, respectively;

a metallic shielding plate retained by the housing and between the upper and the lower rows of contacts, and including a main portion in the tongue, a plate portion located behind the main portion in a front-to-back direction and above the main portion in a vertical direction perpendicular to the front-to-back direction, and a transitional portion between the main portion and the plate portion in the front-to-back direction; and a metallic shielding shell having a tubular portion enclosing the tongue, a rear cover located behind the tubular portion in the front-to-back direction and above the tubular portion in the vertical direction, and downwardly shielding the base in the vertical direction, and a step between the tubular portion and the rear cover in the front-to-back direction corresponding to the transitional portion; wherein the rear cover has a soldering leg mechanically and electrically contacts a tail which extends from the plate portion of the shielding plate; wherein the tail defines a lying L-shaped configuration and the soldering leg defines an upstanding L-shaped configuration, and a bearing portion of the soldering leg forms an upward protrusion abutting upwardly against the tail.

* * * * *